US009158317B2

(12) United States Patent
Son

(10) Patent No.: US 9,158,317 B2
(45) Date of Patent: Oct. 13, 2015

(54) INTERNAL VOLTAGE GENERATION CIRCUITS

(71) Applicant: SK hynix Inc., Icheon-si Gyeonggi-do (KR)

(72) Inventor: Jong Ho Son, Icheon-si (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 14/155,544

(22) Filed: Jan. 15, 2014

(65) Prior Publication Data

US 2015/0035590 A1 Feb. 5, 2015

(30) Foreign Application Priority Data

Jul. 30, 2013 (KR) ..... 10-2013-0089983

(51) Int. Cl.
*G05F 3/02* (2006.01)
*G05F 1/10* (2006.01)
*G05F 1/46* (2006.01)

(52) U.S. Cl.
CPC ..... *G05F 1/46* (2013.01)

(58) Field of Classification Search
CPC ..... G05F 3/262; G05F 3/265; G05F 3/30; G05F 3/205; G11C 5/147
USPC ..... 327/530, 538, 540, 541
See application file for complete search history.

(56) References Cited

U.S. PATENT DOCUMENTS

| | | | | |
|---|---|---|---|---|
| 8,330,507 | B2 * | 12/2012 | Kim | 327/143 |
| 2002/0030537 | A1 * | 3/2002 | Kobayashi et al. | 327/541 |
| 2005/0254333 | A1 * | 11/2005 | Do | 365/230.08 |
| 2007/0069809 | A1 * | 3/2007 | Kang | 327/541 |

FOREIGN PATENT DOCUMENTS

| | | | |
|---|---|---|---|
| KR | 1020030043411 | A | 6/2003 |
| KR | 1020030087813 | A | 11/2003 |
| KR | 1020120033439 | A | 4/2012 |

* cited by examiner

*Primary Examiner* — Quan Tra
(74) *Attorney, Agent, or Firm* — William Park & Associates Ltd.

(57) ABSTRACT

An internal voltage generation circuit including a drive control signal generator and an internal voltage driver. The drive control signal generator generates a drive control signal in response to an active pulse signal and a drive signal. The internal voltage driver, electrically coupled to the drive control signal generator, divides a level of an internal voltage signal in response to the drive control signal to generate a division voltage signal, compares a level of the division voltage signal with a level of a reference voltage signal to generate the drive signal, and drives the internal voltage signal in response to the drive signal.

18 Claims, 6 Drawing Sheets

INTERNAL VOLTAGE GENERATION CIRCUITS

CROSS-REFERENCE TO RELATED APPLICATION

The present application claims priority under 35 U.S.C 119(a) to Korean Application No. 10-2013-0089983, filed on Jul. 30, 2013, in the Korean Intellectual Property Office, which is incorporated herein by reference in its entirety as set forth in full.

BACKGROUND

1. Technical Field

Embodiments of the present disclosure generally relate to semiconductor integrated circuits and, more particularly, to internal voltage generation circuits.

2. Related Art

In general, semiconductor memory devices receive a power supply voltage VDD and a ground voltage VSS from an external system to generate internal voltages used in operations of internal circuits constituting each semiconductor memory device. The internal voltages for operating the internal circuits of the semiconductor memory devices may include a core voltage VCORE supplied to memory core regions, a high voltage VPP used to drive or overdrive word lines, and a back-bias voltage VBB applied to a bulk region (or a substrate) of NMOS transistors in the memory core region.

The core voltage VCORE may be a positive voltage which is lower than the power supply voltage VDD supplied from the external system. Thus, the core voltage VCORE may be generated by lowering the power supply voltage VDD to a certain level. In contrast, the high voltage VPP may be higher than the power supply voltage VDD, and the back-bias voltage VBB may be a negative voltage which is lower than the ground voltage VSS. Thus, charge pump circuits may be required to generate the high voltage VPP and the back-bias voltage VBB.

SUMMARY

Various embodiments are directed to internal voltage generation circuits.

According to various embodiments, an internal voltage generation circuit includes a drive control signal generator and an internal voltage driver. The drive control signal generator generates a drive control signal in response to an active pulse signal and a drive signal. The internal voltage driver, electrically coupled to the drive control signal generator, divides a level of an internal voltage signal in response to the drive control signal to generate a division voltage signal, compares a level of the division voltage signal with a level of a reference voltage signal to generate the drive signal, and drives the internal voltage signal in response to the drive signal.

According to further embodiments, an internal voltage generation circuit includes a first drive control signal generator configured to generate a first drive control signal in response to an active pulse signal and a first drive signal, a first internal voltage driver electrically coupled with the first drive control signal generator, and configured to compare a level of a first division voltage signal generated by dividing a level of a first internal voltage signal in response to the first drive control signal with a level of a first reference voltage signal to generate the first drive signal and configured to drive the first internal voltage signal in response to the first drive signal, a second drive control signal generator electrically coupled with the first drive control signal generator, and configured to generate a second drive control signal in response to the active pulse signal and a second drive signal, and a second internal voltage driver electrically coupled with the second drive control signal generator, and configured to compare a level of a second division voltage signal generated by dividing a level of a second internal voltage signal in response to the second drive control signal with a level of a second reference voltage signal to generate the second drive signal and configured to drive the second internal voltage signal in response to the second drive signal.

BRIEF DESCRIPTION OF THE DRAWINGS

Embodiments of the present invention will become more apparent in view of the attached drawings and accompanying detailed descriptions, in which.

DETAILED DESCRIPTION OF THE EMBODIMENTS

Various embodiments of the present invention will be described hereinafter with reference to the accompanying drawings. However, the embodiments described herein are for illustrative purposes only and are not intended to limit the scope of the present invention.

Figure 1:
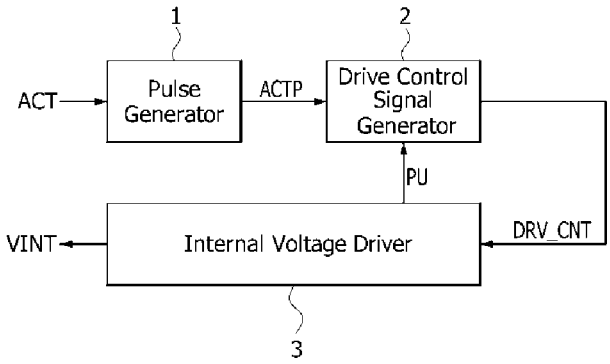
FIG. 1 is a block diagram illustrating an internal voltage generation circuit according to an embodiment of the present invention.

Referring to FIG. 1, an internal voltage generation circuit according to an embodiment of the present invention may include a pulse generator 1, a drive control signal generator 2 and an internal voltage driver 3.

The pulse generator 1 may generate an active pulse signal ACTP in response to an active signal ACT. The active signal ACT may be enabled to have a logic "high" level in synchronization with an active command signal and may be disabled to have a logic "low" level in synchronization with a precharge command signal. The drive control signal generator 2 may generate a drive control signal DRV_CNT in response to the active pulse signal ACTP and a drive signal PU. The drive control signal DRV_CNT may be enabled to have a logic "high" level in synchronization with the active pulse signal ACTP and may be disabled to have a logic "low" level in synchronization with the drive signal PU. The internal voltage driver 3 may generate the drive signal PU according to a level of an internal voltage signal VINT in a period that the drive control signal DRV_CNT is enabled and may drive the internal voltage signal VINT in response to the drive signal PU.

Figure 2:
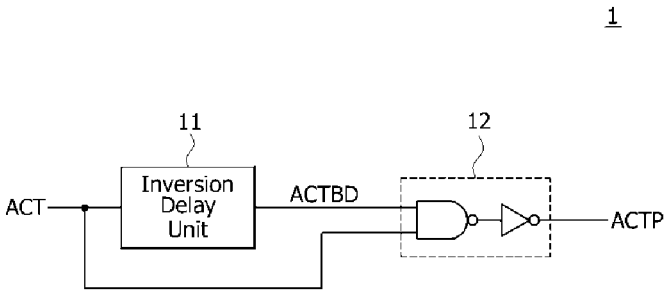
FIG. 2 is a schematic diagram illustrating a pulse generator included in the internal voltage generation circuit of FIG. 1.

Referring to FIG. 2, the pulse generator 1 may include an inversion delay unit 11 and a logic unit 12. The inversion delay unit 11 may invert the active signal ACT and may retard the inverted active signal by a predetermined delay time to generate a complementary delayed active signal ACTBD. The logic unit 12 may generate the active pulse signal ACTP including a pulse that has a width corresponding to a period that both the active signal ACT and the complementary delayed active signal ACTBD are enabled to have a logic "high" level. That is, the pulse of the active pulse signal ACTP may be created to have a width corresponding to a period from a moment that the active signal ACT is enabled until a moment that a delay time of the inversion delay unit 11 elapses. A combination of logic levels to which the active signal ACT and the complementary delayed active signal ACTBD are enabled may be set to be different according to the embodiments.

Figure 3:
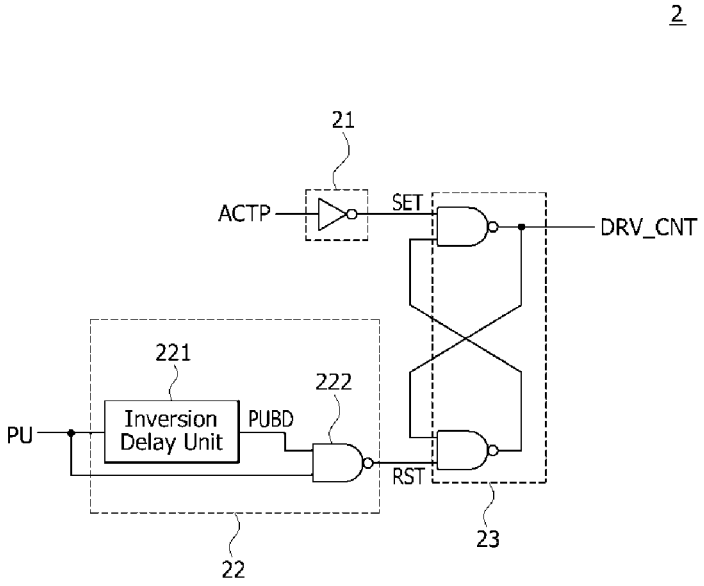
FIG. 3 is a schematic diagram illustrating a drive control signal generator included in the internal voltage generation circuit of FIG. 1.

Referring to FIG. 3, the drive control signal generator 2 may include a set signal generator 21, a reset signal generator 22 and a latch unit 23. The set signal generator 21 may inversely buffer the active pulse signal ACTP to generate a set signal SET. The set signal SET may be enabled to have a logic "low" level at a moment that the active pulse signal ACTP has a logic "high" level. The reset signal generator 22 may include an inversion delay unit 221 and a logic element 222. The inversion delay unit 221 may invert the drive signal PU and may retard the inverted drive signal by a predetermined delay time to generate a complementary delayed drive signal PUBD. The logic element 222 may generate a reset signal RST enabled to have a logic "low" level during a period that both the drive signal PU and the complementary delayed drive signal PUBD have a logic "high" level. That is, the reset signal RST may be enabled to have a logic "low" level during a period from a moment that the drive signal PU is disabled to have a logic "high" level after the drive signal PU is enabled to have a logic "low" level until a moment that a delay time of the inversion delay unit 221 elapses. The latch unit 23 may generate the drive control signal DRV_CNT enabled to have a logic "high" level from a moment that the set signal SET is enabled to have a logic "low" level until a moment that the reset signal RST is enabled to have a logic "low" level after the set signal SET is disabled to have a logic "high" level. A combination of the logic levels that the set signal SET, the reset signal RST and the drive control signal DRV_CNT are enabled may be set to be different according to the embodiments.

Figure 4:
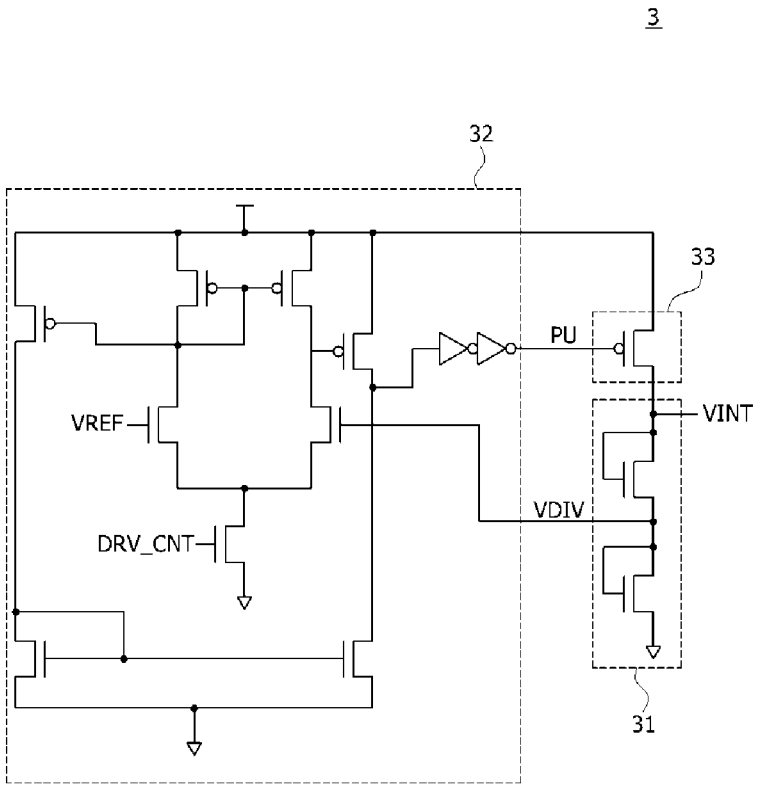
FIG. 4 is a circuit diagram illustrating an internal voltage driver included in the internal voltage generation circuit of FIG. 1.
Figure 5:
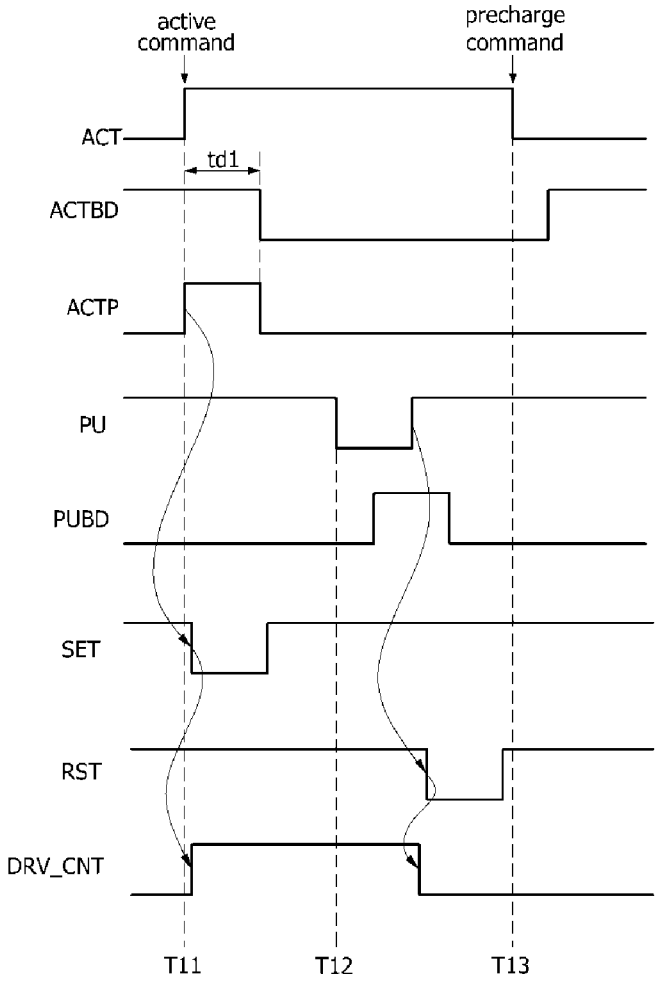
FIG. 5 is a timing diagram illustrating an operation of the internal voltage generation circuit shown in FIG. 1.

Referring to FIG. 4, the internal voltage driver 3 may include a voltage divider 31, a comparator 32 and a driver 33. The voltage divider 31 may divide a level of the internal voltage signal VINT to generate a division voltage signal VDIV. The comparator 32 may compare a level of the division voltage signal VDIV with a level of a reference voltage signal VREF to generate the drive signal PU during a period that the drive control signal DRV_CNT is enabled to have a logic "high" level. The drive signal PU may be enabled to have a logic "low" level when the level of the division voltage signal VDIV is lowered than the level of the reference voltage signal VREF. The driver 33 may drive the internal voltage signal VINT when the drive signal PU is enabled to have a logic "low" level.

An operation of the internal voltage generation circuit set forth above will be developed hereinafter with reference to FIGS. 1, 2, 3, 4 and 5.

If an active command signal is inputted at a point of time "T11" and a pre-charge command signal is inputted at a point of time "T13", the active signal ACT may be enabled to have a logic "high" level from the point of time "T11" till the point of time "T13". The pulse generator 1 may retard the active signal ACT by a delay time TD1 and may invert the delayed active signal to generate the complementary delayed active signal ACTBD and to generate the active pulse signal ACTP including a pulse that has a width corresponding to the delay time TD1 from the point of time "T11".

If the level of the internal voltage signal VINT is lowered to enable the drive signal PU to have a logic "low" level at a point of time "T12", the drive signal PU may be retarded and inverted to generate the complementary delayed drive signal PUBD.

The set signal SET may be enabled to have a logic "low" level in synchronization with the pulse of the active pulse signal ACTP. The reset signal RST may be enabled to have a logic "low" level in synchronization with a moment that the drive signal PU is disabled to have a logic "high" level after the drive signal PU is enabled to have a logic "low" level, that is, in synchronization with a rising edge of the drive signal PU. The drive control signal DRV_CNT may be enabled from a moment that the set signal SET is enabled to have a logic "low" level until a moment that the reset signal RST is enabled to have a logic "low" level after the set signal SET is disabled to have a logic "high" level, thereby controlling a drive time of the internal voltage signal VINT generated by the internal voltage driver 3. Thus, the internal voltage signal VINT may be driven from a moment that the pulse of the active pulse signal ACTP is generated until a moment that a rising edge of the drive signal PU is created.

As described above, the internal voltage generation circuit illustrated in FIG. 1 may begin a drive of the internal voltage signal VINT in response to the active command signal and may terminate the drive of the internal voltage signal VINT after a predetermined time. That is, an operation of the internal voltage driver 3 for driving the internal voltage signal VINT may be terminated after the internal voltage signal VINT is driven. Thus, the power consumption of the internal voltage generation circuit may be minimized.

Figure 6:
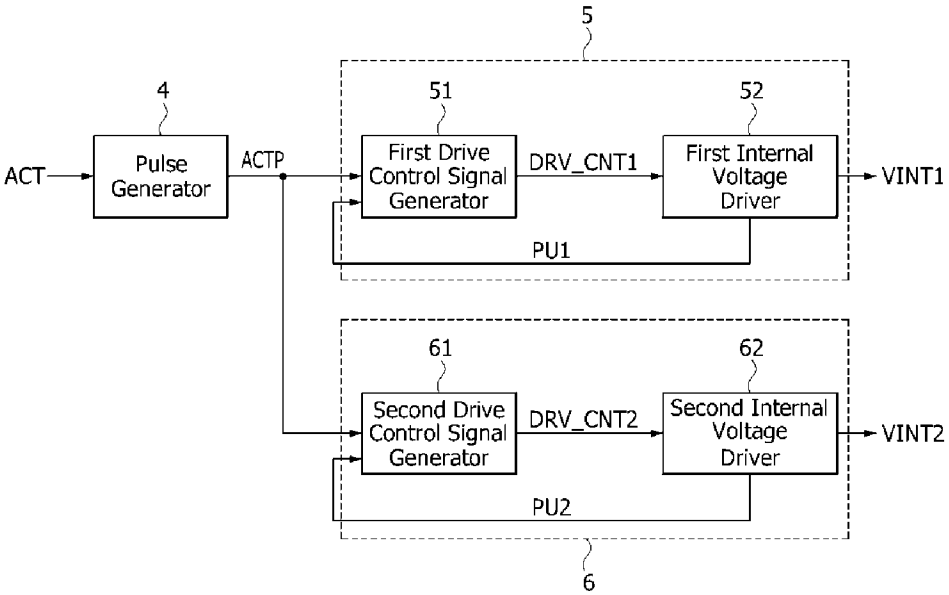
FIG. 6 is a block diagram illustrating an internal voltage generation circuit according to an embodiment of the present invention.

Referring to FIG. 6, an internal voltage generation circuit according to an embodiment of the present invention may include a pulse generator 4, a first internal voltage generator 5 and a second internal voltage generator 6. The first internal voltage generator 5 may include a first drive control signal generator 51 and a first internal voltage driver 52. The second internal voltage generator 6 may include a second drive control signal generator 61 and a second internal voltage driver 62.

The pulse generator 4 may generate an active pulse signal ACTP in response to an active signal ACT. The pulse generator 4 may be realized to have substantially the same configuration as the pulse generator 1 illustrated in FIGS. 1 and 2. Thus, a detailed description and operation of the pulse generator 4 will be omitted hereinafter.

The first drive control signal generator 51 may generate a first drive control signal DRV_CNT1 in response to the active pulse signal ACTP and a first drive signal PU1. The first drive control signal DRV_CNT1 may be enabled to have a logic "high" level in synchronization with the active pulse signal ACTP and may be disabled to have a logic "low" level in synchronization with the first drive signal PU1. The first drive control signal generator 51 may be realized to have substantially the same configuration as the drive control signal generator 2 illustrated in FIGS. 1 and 3. Thus, a detailed description and operation of the first drive control signal generator 51 will be omitted hereinafter.

The first internal voltage driver 52 may generate the first drive signal PU1 according to a level of a first internal voltage signal VINT1 in a period that the first drive control signal DRV_CNT1 is enabled and may drive the first internal voltage signal VINT1 in response to the first drive signal PU1.

The first internal voltage driver 52 may be realized to have substantially the same configuration as the internal voltage driver 3 illustrated in FIGS. 1 and 4. Thus, a detailed description and operation of the first internal voltage driver 52 will be omitted hereinafter.

The second drive control signal generator 61 may generate a second drive control signal DRV_CNT2 in response to the active pulse signal ACTP and a second drive signal PU2. The second drive control signal DRV_CNT2 may be enabled to have a logic "high" level in synchronization with the active pulse signal ACTP and may be disabled to have a logic "low" level in synchronization with the second drive signal PU2. The second drive control signal generator 61 may be realized to have substantially the same configuration as the drive control signal generator 2 illustrated in FIGS. 1 and 3. Thus, a detailed description and operation of the second drive control signal generator 61 will be omitted hereinafter.

The second internal voltage driver 62 may generate the second drive signal PU2 according to a level of a second internal voltage signal VINT2 in a period that the second drive control signal DRV_CNT2 is enabled and may drive the second internal voltage signal VINT2 in response to the second drive signal PU2. The second internal voltage driver 62 may be realized to have substantially the same configuration as the internal voltage driver 3 illustrated in FIGS. 1 and 4. Thus, a detailed description and operation of the second internal voltage driver 62 will be omitted hereinafter.

As described above, the internal voltage generation circuit illustrated in FIG. 6 may simultaneously begin the drives of the first and second internal voltage signals VINT1 and VINT2 in response to the active command signal. However, the drive of the first internal voltage signal VINT1 may be terminated after the first internal voltage signal VINT1 is driven and the drive of the second internal voltage signal VINT2 may be terminated after the second internal voltage signal VINT2 is driven. That is, a period that the first internal voltage signal VINT1 is driven may be controlled according to a level of the first internal voltage signal VINT1 and a period that the second internal voltage signal VINT2 is driven may be controlled according to a level of the second internal voltage signal VINT2. Thus, drive times of the first and second internal voltage signals VINT1 and VINT2 may be separately controlled according to levels of the first and second internal voltage signals VINT1 and VINT2.

Moreover, the internal voltage generation circuit may terminate the drive of the first internal voltage signal VINT1 after the first internal voltage signal VINT1 is fully driven and may terminate the drive of the second internal voltage signal VINT2 after the second internal voltage signal VINT2 is fully driven. As a result, the power consumption of the internal voltage generation circuit may be minimized.

What is claimed is:

1. An internal voltage generation circuit comprising:

a pulse generator configured to generate an active pulse signal in response to an active signal which has been enabled from a period when an active command signal is inputted to the internal voltage generation circuit until a period when a pre-charge command signal is inputted to the internal voltage generation circuit;

a drive control signal generator configured to generate a drive control signal in response to the active pulse signal and a drive signal; and an internal voltage driver electrically coupled to the drive control signal generator, and configured to divide a level of an internal voltage signal in response to the drive control signal to generate a division voltage signal, compare a level of the division voltage signal with a level of a reference voltage signal to generate the drive signal, and drive the internal voltage signal in response to the drive signal, wherein the drive control signal generator includes a reset signal generator configured to generate a reset signal enabled in response to the drive signal, and a latch unit electrically coupled to the reset signal generator and configured to generate the drive control signal in response to a set signal and the reset signal, wherein the set signal is enabled in synchronization with the active pulse signal.

2. The internal voltage generation circuit of claim 1, wherein the active pulse signal is generated in synchronization with the active command signal.

3. The internal voltage generation circuit of claim 2, wherein the pulse generator includes:

an inversion delay unit configured to invert and retard the active signal; and a logic unit electrically coupled with the inversion delay unit, and configured to generate the active pulse signal in response to the active signal and an output signal of the inversion delay unit.

4. The internal voltage generation circuit of claim 1, wherein the drive control signal is enabled in synchronization with the active pulse signal and is disabled in synchronization with the drive signal.

5. The internal voltage generation circuit of claim 1, wherein the reset signal is enabled during a predetermined delay time from a moment that the drive signal is disabled after enablement of the drive signal.

6. The internal voltage generation circuit of claim 1, wherein the drive control signal is enabled from a moment that the set signal is enabled until a moment that the reset signal is enabled.

7. The internal voltage generation circuit of claim 1, wherein the drive signal is enabled to drive the internal voltage signal when the level of the division voltage signal is lower than the level of the reference voltage signal.

8. The internal voltage generation circuit of claim 7, wherein the internal voltage driver includes:

a voltage divider configured to divide a level of the internal voltage signal to generate the division voltage signal;

a comparator electrically coupled with the voltage divider, and configured to compare the level of the division voltage signal with the level of the reference voltage signal to generate the drive signal while the drive control signal is enabled; and a driver electrically coupled to both the comparator and the voltage divider, and configured to drive the internal voltage signal in response to the drive signal.

9. An internal voltage generation circuit comprising:

a pulse generator configured to generate an active pulse signal in response to an active signal which has been enabled from a period when an active command signal is inputted to the internal voltage generation circuit until a period when a pre-charge command signal is inputted to the internal voltage generation circuit;

a first drive control signal generator configured to generate a first drive control signal in response to the active pulse signal and a first drive signal;

a first internal voltage driver electrically coupled with the first drive control signal generator, and configured to compare a level of a first division voltage signal generated by dividing a level of a first internal voltage signal in response to the first drive control signal with a level of a first reference voltage signal to generate the first drive signal and configured to drive the first internal voltage signal in response to the first drive signal;

a second drive control signal generator electrically coupled with the first drive control signal generator, and configured to generate a second drive control signal in response to the active pulse signal and a second drive signal; and a second internal voltage driver electrically coupled with the second drive control signal generator, and configured to compare a level of a second division voltage signal generated by dividing a level of a second internal voltage signal in response to the second drive control signal with a level of a second reference voltage signal to generate the second drive signal and configured to drive the second internal voltage signal in response to the second drive signal, wherein the first drive control signal generator includes a reset signal generator configured to generate a reset signal enabled in response to the first drive signal and a latch unit electrically coupled to the reset signal generator, and configured to generate the first drive control signal in response to a set signal and the reset signal, wherein the set signal is enabled in synchronization with the active pulse signal.

10. The internal voltage generation circuit of claim 9, wherein the active pulse signal is generated in synchronization with the active command signal inputted to the internal voltage generation circuit.

11. The internal voltage generation circuit of claim 10, wherein the pulse generator includes:

an inversion delay unit configured to invert and retard the active signal; and a logic unit electrically coupled with the inversion delay unit, and configured to generate the active pulse signal in response to the active signal and an output signal of the inversion delay unit.

12. The internal voltage generation circuit of claim 9, wherein the first drive control signal is enabled in synchronization with the active pulse signal and is disabled in synchronization with the first drive signal.

13. The internal voltage generation circuit of claim 9, wherein the reset signal is enabled during a predetermined delay time from a moment that the first drive signal is disabled after enablement of the first drive signal.

14. The internal voltage generation circuit of claim 9, wherein the first drive control signal is enabled from a moment that the set signal is enabled until a moment that the reset signal is enabled.

15. The internal voltage generation circuit of claim 9, wherein the second drive control signal is enabled in synchronization with the active pulse signal and is disabled in synchronization with the second drive signal.

16. The internal voltage generation circuit of claim 9, wherein the first drive signal is enabled to drive the first internal voltage signal when the level of the first division voltage signal is lower than the level of the first reference voltage signal.

17. The internal voltage generation circuit of claim 16, wherein the first internal voltage driver includes:

a voltage divider configured to divide a level of the first internal voltage signal to generate the first division voltage signal;

a comparator electrically coupled with the voltage divider, and configured to compare the level of the first division voltage signal with the level of the first reference voltage signal to generate the first drive signal while the first drive control signal is enabled; and a driver electrically coupled to both the comparator and the voltage divider, and configured to drive the first internal voltage signal in response to the first drive signal.

18. The internal voltage generation circuit of claim 16, wherein the second drive signal is enabled to drive the second internal voltage signal when the level of the second division voltage signal is lower than the level of the second reference voltage signal.

* * * * *